US009322226B2

(12) United States Patent
Skinnes

(10) Patent No.: US 9,322,226 B2
(45) Date of Patent: Apr. 26, 2016

(54) DEVICE FOR A SAFETY CONNECTOR FOR A PIPE STRING SUSPENSION

(75) Inventor: Kenneth Skinnes, Stavanger (NO)

(73) Assignee: WellPartner AS, Tananger (NO)

( * ) Notice: Subject to any disclaimer, the term of this patent is extended or adjusted under 35 U.S.C. 154(b) by 923 days.

(21) Appl. No.: 13/516,191

(22) PCT Filed: Dec. 15, 2010

(86) PCT No.: PCT/NO2010/000462

§ 371 (c)(1),
(2), (4) Date: Jul. 12, 2012

(87) PCT Pub. No.: WO2011/074984

PCT Pub. Date: Jun. 23, 2011

(65) Prior Publication Data

US 2012/0267117 A1 Oct. 25, 2012

(30) Foreign Application Priority Data

Dec. 15, 2009 (NO) ..... 20093519

(51) Int. Cl.
*E21B 19/09* (2006.01)
*E21B 17/08* (2006.01)
*E21B 19/00* (2006.01)

(52) U.S. Cl.
CPC ..... *E21B 17/085* (2013.01); *E21B 19/006* (2013.01)

(58) Field of Classification Search
CPC .... E21B 19/004; E21B 19/006; E21B 17/085
USPC ..... 166/335, 360; 405/224.4; 138/109, 120, 138/155, 114; 285/188
See application file for complete search history.

(56) References Cited

U.S. PATENT DOCUMENTS

| | | | | |
|---|---|---|---|---|
| 2,945,677 | A | | 7/1960 | Kammerer |
| 3,208,728 | A | | 9/1965 | Parks |
| 3,687,205 | A | | 8/1972 | Mori |
| 3,718,316 | A | | 2/1973 | Larralde et al. |
| 3,785,445 | A | | 1/1974 | Scozzafava |
| 3,793,835 | A | * | 2/1974 | Larralde ..... 60/413 |
| 3,841,607 | A | * | 10/1974 | Larralde et al. ..... 254/392 |
| 4,004,532 | A | | 1/1977 | Reynolds |
| 4,039,177 | A | | 8/1977 | Person et al. |

(Continued)

FOREIGN PATENT DOCUMENTS

| | | |
|---|---|---|
| EP | 14289973 A1 | 6/2004 |
| WO | 00/05483 A1 | 2/2000 |

(Continued)

OTHER PUBLICATIONS

"Choice and application of motion-compensation systems (MCS)", J.P. Manesse, ACB Alsthom Atlantique, Offshore 83 Conference Aberdeen, Sep. 6-9, 1983.

(Continued)

*Primary Examiner* — Matthew R Buck
*Assistant Examiner* — Stacy Warren
(74) *Attorney, Agent, or Firm* — Andrus Intellectual Property Law, LLP

(57) ABSTRACT

A device is for a release module for attaching a pipe string to a heave compensated, load bearing unit arranged on a floating installation, where two or more hydraulic cylinder units form an extendable connection between the heave compensated, load bearing unit and a portion of the pipe string.

17 Claims, 2 Drawing Sheets

(56) References Cited

U.S. PATENT DOCUMENTS

| | | | | |
|---|---|---|---|---|
| 4,236,695 | A | 12/1980 | Morrison | |
| 4,280,531 | A * | 7/1981 | Milberger et al. | 137/624.11 |
| 4,362,438 | A | 12/1982 | Spink | |
| 4,432,420 | A | 2/1984 | Gregory et al. | |
| 5,209,302 | A * | 5/1993 | Robichaux et al. | 166/355 |
| 6,691,784 | B1 | 2/2004 | Wanvik | |
| 7,231,981 | B2 | 6/2007 | Moe et al. | |
| 7,921,867 | B2 | 4/2011 | Groves | |
| 8,251,148 | B2 | 8/2012 | von der Ohe | |
| 2004/0099421 | A1 * | 5/2004 | Trewhella | 166/355 |
| 2005/0077049 | A1 | 4/2005 | Moe et al. | |
| 2006/0196671 | A1 * | 9/2006 | Robichaux | 166/340 |

FOREIGN PATENT DOCUMENTS

| | | | |
|---|---|---|---|
| WO | 0188323 | | 11/2001 |
| WO | 2007/145503 | A1 | 12/2007 |
| WO | 2007139394 | | 12/2007 |

OTHER PUBLICATIONS

"Compensated Coiled Tubing Lift Frame. Operations and Maintenance Manual. Issue E" issued by ODS International on Aug. 2011 as a revised version of Issue B dated Jun. 2, 2009.

Disclosure made by Icon Engineering Pty Ltd to National Oilwell Hitec on Apr. 6, 2000.

Disclosure made by Icon Engineering Pty Ltd to Schlumberger Oilfield Services on Dec. 7, 2005.

Disclosure made by Icon Engineering Pty Ltd to Statoil on Mar. 16, 1999.

"Drilling rigs stand up to the power of the ocean", Craig LaFave, Omstead Products Co., Hydraulics & Pneumatics, Jun. 2004.

"Guidelines for Design and Operation of Drilling Heave Compensation Systems or mobile drilling units operating on the Norwegian Continental Shelf", edited by Proffshore AS, issued Dec. 23, 1999.

"Operating and Maintenance Procedures Manual. Motion Compensating Lift Frame Package" issued by The Expro Group on Nov. 27, 2001 and accompanying System Schematic WT/SLF/003.

"Unintentional Compensator Lockup Risks, Consequences and Measures", Storegjerde, D., et al., International Association of Drilling Contractors/Society of Petroleum Engineers Drilling Conference, New Orleans, Louisiana, Feb. 23-25, 2000.

Section D. Heave Compensation and Tensioning System, D204, Offshore Standard DNV-OS-E101 Drilling Plant, Oct. 2009.

Statement of Grounds and Particulars for AU Patent Application No. 2010332372 dated Mar. 17, 2015.

International Search Report for parent application PCT/NO2010/000462, having a mailing date of Mar. 2, 2011.

Written Opinion for parent application PCT/NO2010/000462, having a mailing date of Mar. 2, 2011.

Applicant's Reply of Sep. 21, 2011 to Written Opinion dated Mar. 2, 2011 for parent application PCT/NO2010/000462.

Written Opinion for parent application PCT/NO2010/0010462, having a mailing date of Feb. 29, 2012.

International Preliminary Report on Patentability for parent application PCT/NO2010/000462, having a completion date of Mar. 21, 2012.

* cited by examiner

DEVICE FOR A SAFETY CONNECTOR FOR A PIPE STRING SUSPENSION

CROSS-REFERENCE TO RELATED APPLICATIONS

This application is the U.S. national stage application of International Application No. PCT/NO2010/000462, filed Dec. 15, 2010, which International application was published on Jun. 23, 2011 as International Publication No. WO 2011/074984 A1 in the English language and which application is incorporated herein by reference. The International application claims priority of Norwegian Patent Application No. 20093519, filed Dec. 15, 2009, which application is incorporated herein by reference.

BACKGROUND

There is described a device for a release module for attaching a pipe string to a heave compensated, load bearing unit arranged on a floating installation, more particularly in that two or more hydraulic cylinder units form an extendable connection between the heave compensated, load bearing unit and a portion of the pipe string.

Working on a well, such as an oil or gas well, from a floating installation (in the following also called a rig), equipment led down into the well is as a rule connected to the rig via some form of heave compensator to prevent that well equipment moves in the vertical direction in line with the wave or current induced heave motion of the rig.

By using a so-called workover riser in combination with a top drive, the workover riser is suspended from the top drive via rigid suspension links ("bails). The top drive heave compensator thereby functions also as the workover riser heave compensator. To prevent the workover riser from being broken in case the heave compensator fails, a so-called "weak link" i.e. a weakened unit is interconnected in the suspension. This element is according to prior art often made with some sort of shear pin device which when it breaks frees the workover pipe from the top drive. The drawback with such devices is that partly heavy components may come loose and thereby fall down on the deck below hurting personnel being there.

Also in heave compensated suspensions of other types of pipe strings, failure in the connected heave compensator may create the same problems as described above.

SUMMARY

The object of the invention is to remedy or reduce at least one of the disadvantages of the prior art, or at least provide a useful alternative to the prior art.

The object is achieved by the features disclosed in the below description and in the subsequent claims.

Between a load bearing, heave compensated unit, such as a top drive, and a pipe string, there is provided at least two single acting hydraulic cylinder units in such a manner that an upwardly facing cylinder end is connected to the top drive while the pipe string is connected to a piston rod extending out from a downward facing cylinder end. A hydraulic pressure through a fluid port in said downward facing cylinder end causes a cylinder piston to pull the piston rod into the cylinder. The fluid port is preferably in fluid communication with a pressure accumulator. This is preferably positioned remote from the hydraulic cylinders for safety reasons, for example on or at an adjacent drill floor, but a position in the immediate vicinity of the hydraulic cylinders may be considered. The pressure accumulator is preferably provided as a lengthy, cylindrical body, alternatively several cylindrical bodies connected in parallel by means of an accumulator manifold. A movable accumulator wall, e.g. formed as a floating piston, forms a partition between a hydraulic fluid chamber in fluid communication with a piston rod space in the hydraulic cylinder via a hydraulic fluid circuit, and a gas chamber holding a pressurised gas. The gas chamber is in fluid communication with a gas reservoir such as a gas bottle battery via an accumulator fluid line.

The operating volume of the accumulator unit, i.e. the volume that the gas chamber and the hydraulic fluid chamber, respectively, may hold, exceeds preferably the collected operating volume of all the hydraulic cylinder units. Thereby the hydraulic cylinder units may be able to move in their full length without being limited by the accumulator unit working range.

The hydraulic fluid circuit is preferably provided with a common first fluid line extending from the accumulator unit to an area close to the top drive, where to a manifold is connected separate, second fluid lines each leading up to and connected to a hydraulic cylinder unit.

The hydraulic fluid circuit is preferably provided with a safety valve arranged at the hydraulic cylinder unit fluid port. The safety valve is arranged to be able to hold the hydraulic fluid circuit closed, i.e. close for fluid communication between the hydraulic cylinder unit and the accumulator unit as long as the pressure in the hydraulic cylinder unit is within defined limits. If the pressure exceeds said limit, the safety valve opens so that hydraulic fluid is drained through the hydraulic fluid circuit to the accumulator unit. This may be able to prevent a too high tension in the pipe string. The other way round a pressure drop below a lower limit will provide for the safety valve opening and a pressure rise provides for the pipe string being stretched and buckling is avoided.

A hydraulic fluid inlet in the accumulator unit is advantageously provided with a stop valve arranged to be able to close the hydraulic fluid inlet at sudden pressure lapse in the hydraulic fluid circuit, for example on hydraulic fluid line rupture. Discharge of hydraulic fluid held in the accumulator unit is thereby prevented.

Finally each hydraulic cylinder unit is preferably provided with a mechanical piston lock, which for safety reasons shall be able to lock a fully retracted piston rod to the cylinder and thereby be able to carry a larger load than what can be done with a preferred hydraulic working pressure in the hydraulic cylinder unit. The piston lock is advantageously provided with a remote operated lock actuator, such as being hydraulically operated.

Hydraulic and accumulator fluid lines are installed between the hydraulic cylinder unit and the gas reservoir in a for the purpose suitable manner. In one embodiment of the invention one of said lines is introduced into a drilling fluid line through a fluid tight packer arranged in a branch of the drilling fluid line that in an end portion is connected to the top drive. The branch is arranged in a suitable place remote from the top drive. Said line is thereby lying protected in the drilling fluid line up to a drilling fluid outlet arranged in the top drive, where it is connected to the previously mentioned pressure line manifold.

By this arrangement is obtained the advantage of providing a connection between the pipe string and its heave compensator where an overloading of the pipe string in the form of over tensioning or lapse of lift due to failure of the heave compensator leads to the hydraulic cylinder unit safety valve reducing or, respectively increasing the working pressure in the hydraulic cylinder unit. Thereby the top drive, which due to the lapse in the heave compensator follows the heave motion of the rig, may be moved relative to the pipe string, as the piston rod is allowed to move in the hydraulic cylinder, so that the pipe string remain stationary relative to the well as long as the heave motion is within the stroke of the hydraulic cylinder.

More particularly the invention relates to a device for a release module for fastening a pipe string in a heave compensated, load bearing unit arranged on a floating installation, characterised in that two or more hydraulic cylinder units form an extendable connection between the heave compensated, load bearing unit and a portion of the pipe string.

A piston rod may protrude from a downward facing cylinder end.

The hydraulic cylinder units may be releasably attached to the pipe string by means of a pipe clamp.

The hydraulic cylinder unit may be arranged to be able to pull the pipe clamp toward the heave compensated, load bearing unit.

The hydraulic cylinder unit may in a fluid communicating manner be connected to an accumulator unit via a hydraulic fluid circuit.

The hydraulic fluid circuit may comprise a safety valve.

The hydraulic fluid circuit may comprise a safety valve arranged to be able to open for hydraulic fluid communication between the cylinder units and the accumulator unit when a hydraulic fluid pressure exceeds an upper limit or falls below a lower limit.

The accumulator unit may be provided with at least one cylindrical accumulator housing where a floating piston forms a movable wall between a hydraulic fluid chamber and a gas chamber, and where the accumulator unit operating volume is at least as large as the sum of the operating volumes of the hydraulic cylinder units.

The accumulator unit gas chamber may in a fluid communicating manner be connected to a pressurised gas reservoir.

The heave compensated, load-bearing unit may be a top drive.

A drilling fluid line arranged for fluid communication with a drilling fluid outlet arranged on the top drive may enclose at least a portion of one or more hydraulic and accumulator fluid lines forming a communication between the hydraulic cylinder unit and a pressurised gas reservoir.

A hydraulic fluid line may be led through a branch and into the drilling liquid line and to a hydraulic line manifold arranged at the top drive drilling fluid outlet.

The hydraulic fluid circuit may be provided with a stop valve arranged to be able to close a hydraulic fluid inlet in the accumulator unit at a sudden pressure drop in the hydraulic fluid circuit.

The cylinder unit may be provided with a piston lock arranged to be able to mechanically hold a piston rod tight in a releasable grip when the piston rod is in a retracted position.

The pipe string may be a workover riser.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
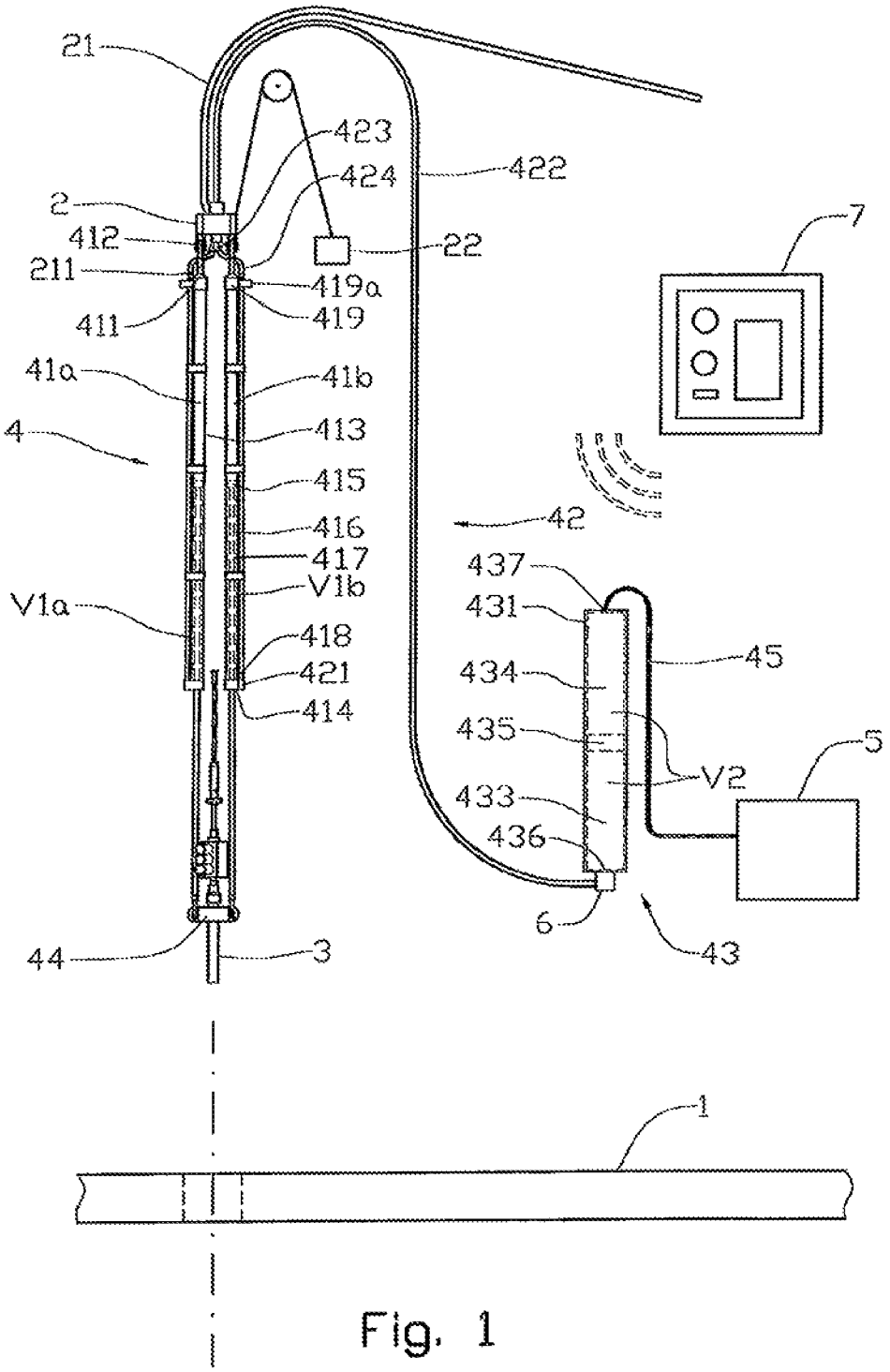
FIG. 1 shows a principle view of a release module according to the invention provided as a suspension of a workover riser in a top drive.
Figure 2:
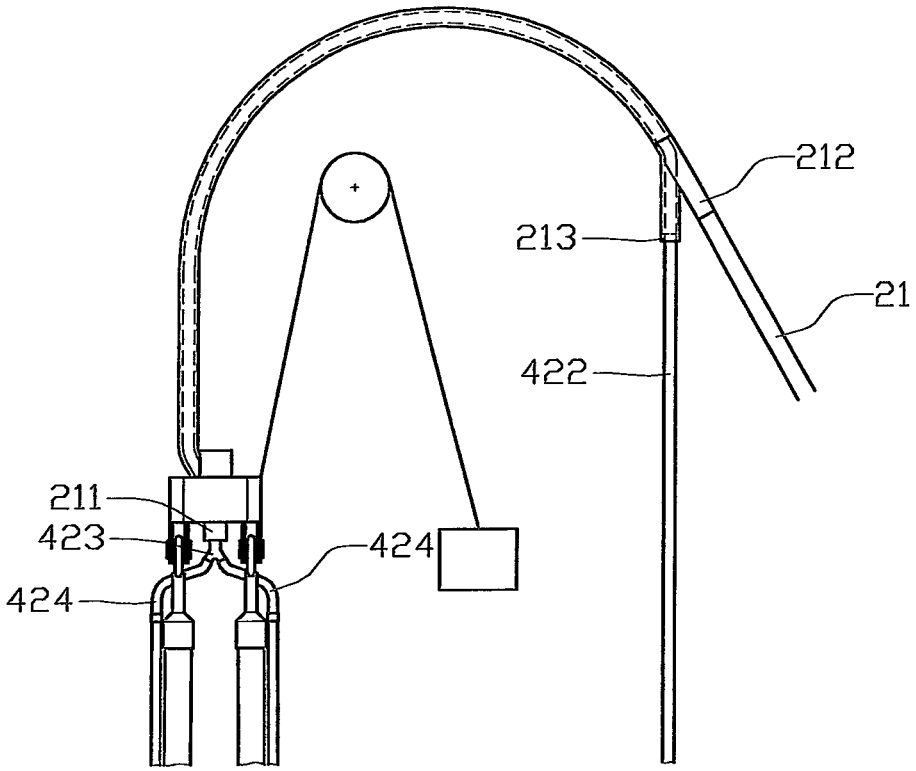
FIG. 2 shows at larger scale a section of an alternative embodiment of the invention, where a hydraulic fluid line is run up to the top drive through a portion of a drilling fluid line.

In the following the present invention is described connected to a top drive, but the invention may be connected to any load bearing unit provided with heave compensation and arranged over an area on a floating installation where borehole operations are performed.

In the figures the reference numeral 1 indicates the floating installation, e.g. a floating drilling rig. A top drive 2 is arranged in a per se known manner, connected to a drilling fluid line 21 having a drilling fluid outlet 211 at the top drive 2 for supply of drilling fluid to a drill string (not shown). To prevent the rig 1 heave motions to be transferred to the top drive 2 and connected equipment, the top drive 2 is suspended in a heave compensator 22 in a per se known manner.

A pipe string 3, shown here as a workover riser, is for an expedient operation suspended in the top drive 2 for by means of its heave compensator 22 to be able to hold a connected down hole tool (not shown) in a desired position in a bore hole (not shown). A pipe clamp 44 is releasably attached to a portion of the workover riser 3, and a release module 4 extends from the suitable coupling portions on the clamp 44 to a suspension portion on the top drive 2.

The release module 4 is provided with several hanging, hydraulic, single acting cylinder units 41*a*, 41*b*, . . . ,41*n*, here shown two, 41*a*, 41*b*, where a first cylinder end 411 forms a closed upwardly facing end portion on the upper portion of a cylinder 413 and provides a cylinder attachment 412 arranged for pivotal connection to the top drive 2. In the opposite lower, downwardly facing end portion of the cylinder 413 a piston rod 416 protrudes from a second cylinder end 414. To an end portion of the piston rod 416 is attached a piston 415 which in a fluid tight manner forms a pressure tight cylinder pressure chamber 417 having a maximum volume V1*a*, V1*b*, . . . ,V1*n*, and which via a fluid port 418 and a hydraulic fluid circuit 42 is in fluid communication with an accumulator unit 43. The fluid port 418 is arranged in the second cylinder end 414.

Each hydraulic cylinder unit 41*a*, 41*b* is provided with a mechanically acting piston lock 419 arranged to be able to hold the piston rod 416 in a releasable grip when the piston rod 416 is displaced to a retracted position. The piston lock 419 is provided with an actuator 419*a* arranged for remote operation of the piston lock 419.

The hydraulic fluid circuit 42 comprises a first hydraulic fluid line 422 extending from the accumulator unit 43 to a hydraulic line manifold 423 arranged near the cylinder attachments 412 of the hydraulic cylinder units 41*a*, 41*b*. From the hydraulic line manifold 423 a second hydraulic fluid line 424 extends along each of the hydraulic cylinder units 41*a*, 41*b* to the second cylinder end 414 where the hydraulic fluid line 424 is connected to the respective hydraulic cylinder units 41*a*, 41*b* fluid port 418 via a safety valve 421.

The accumulator unit 43 comprises a cylindrical accumulator housing 431 that by means of a floating, fluid sealing piston 435 forms a hydraulic fluid chamber 433 and a gas chamber 434. The hydraulic fluid chamber 433 is provided with a hydraulic fluid inlet 436 that is connected to the first hydraulic fluid line 422 via a stop valve 6. The gas chamber 434 is via a gas port 437 connected to an accumulator fluid line 45 which in a fluid communicating manner is connected to a gas reservoir 5 of a per se known design, e.g. a battery of gas bottles filled with nitrogen at a high gas pressure. The accumulator operating volume V2 is at least as large as the sum of the operating volumes V1*a*+V1*b* of the hydraulic cylinder units 41*a*, 41*b*.

The safety valve 421 is set to hold the fluid conduit between the cylinder pressure chamber 417 of the hydraulic cylinder units 41*a*, 41*b* and the hydraulic fluid chamber 433 of the accumulator unit 43 closed as long as the pressure in the cylinder pressure chamber 417 is between an upper and a lower hydraulic fluid limit P1, P2. The upper hydraulic fluid limit P1 decides when the safety valve 421 is to open and prevent that failure in such as the heave compensator 22 of the top drive 2 shall inflict on the workover riser 3 a too large tensile loading, while the lower hydraulic fluid limit P2 decides when the safety valve 421 is to open and prevent that a corresponding failure at an opposite heave motion of the rig inflicts on the workover riser 3 a too large downward acting load due to the workover riser 3 own weight, to thereby prevent buckling of the workover riser 3.

The stop valve 6 is set to close at a sudden pressure drop in the hydraulic fluid circuit 42.

The accumulator unit 43 will typically be made up of several standard accumulators connected in parallel to provide sufficient capacity at a sensible price.

In an alternative embodiment the first hydraulic fluid line 422 is introduced into the drilling fluid line 21 through a branch 212, which at the inlet to the first hydraulic fluid line 422 is provided with a branch packer 213 to ensure fluid tight insertion of the hydraulic fluid line 422. In a corresponding manner the hydraulic fluid line 422 is led out of the drilling fluid outlet 211 through a packer. By this embodiment the hydraulic fluid line 422 is protected in the drilling fluid line 21 in an area of the rig 1 where the risk of lines of this type getting damaged is relatively great due to moving of tools and other elements to and from the drill floor.

In another embodiment (not shown) the hydraulic cylinder units 41*a*, 41*b* may be provided with an accumulator unit 43 each, arranged for example along the periphery of the hydraulic cylinder unit 41*a*, 41*b*. In such an embodiment the gas reservoir 5 is placed remote from the accumulator unit 43. With an embodiment like this, current safety regulations may generate a need for further safety elements not described or shown herein.

A remote operated control unit 7 is arranged in a suitable place on the rig 1, e.g. in a control room (not shown) for monitoring and control of borehole operations. The control unit 7 is typically provided with means (not shown) for remote setting and remote reading of valves 421, 6, monitoring of the gas reservoir 5 and monitoring of the hydraulic fluid pressure in the release module 4.

The invention claimed is:

1. A system for attaching a pipe string on a floating installation, the system comprising:

a heave compensator;

a heave-compensated load bearing unit comprising a top drive that is connected to the heave compensator; and a release module device comprising at least two suspension stays interconnected via a pipe clamp, wherein each suspension stay is constituted of a hydraulic cylinder unit forming an extendable connection between the top drive and a portion of the pipe string, and each of the hydraulic cylinder units is connected in a fluid communicating manner to an accumulator unit via a hydraulic fluid circuit, each of the hydraulic cylinder units having an upwardly facing cylinder end pivotally connected to the top drive, and a downwardly facing cylinder end opposite the upwardly facing cylinder end, wherein the hydraulic fluid circuit comprises a safety valve arrangement configured to be reactive and responsive according to predetermined set hydraulic fluid limits and to hydraulic fluid pressure within each of the hydraulic cylinder units upon failure of the heave compensator to permit or prevent fluid communication between each of the hydraulic cylinder units and the accumulator unit, and wherein an overloading of the pipe string due to failure of the heave compensator causes the safety valve arrangement to reduce or increase working pressure of each of the hydraulic cylinder units so that the top drive, following heave motion of the floating installation upon failure of the heave compensator, is moved relative to the pipe string which remains stationary as long as heave motion is within a stroke of each of the hydraulic cylinder units.

2. The system according to claim 1, wherein a piston rod protrudes from the downwardly facing cylinder end in each of the hydraulic cylinder units.

3. The system according to claim 1, wherein each of the hydraulic cylinder units is arranged to be able to pull the pipe clamp toward the top drive.

4. The system according to claim 1, wherein the safety valve arrangement is arranged to be able to open for hydraulic fluid communication between each of the hydraulic cylinder units and the accumulator unit when the hydraulic fluid pressure exceeds an upper hydraulic limit (P1) or falls below a lower hydraulic limit (P2).

5. The system according to claim 1, wherein the accumulator unit is provided with at least one cylindrical accumulator housing, wherein a floating piston forms a movable wall between a hydraulic fluid chamber and a gas chamber, and where an operating volume (V2) of the accumulator unit is at least as large as the sum of operating volumes (V1*a*+ V1*b*+ . . . +V1*n*) of each of the hydraulic cylinder units.

6. The system according to claim 5, wherein the gas chamber in a fluid communicating manner is connected to a pressurized gas reservoir.

7. The system according to claim 1, wherein a drilling fluid line arranged for fluid communication with a drilling fluid outlet arranged on the top drive, encloses at least a portion of a first hydraulic fluid line of the hydraulic fluid circuit forming a communication between each of the hydraulic cylinder units and the accumulator unit which is connected to a pressurized gas reservoir.

8. The system according to claim 7, wherein the first hydraulic fluid line of the hydraulic fluid circuit is inserted through a branch into the drilling fluid line and connected to a hydraulic line manifold arranged at the drilling fluid outlet on the top drive.

9. The system according to claim 8, wherein a second hydraulic fluid line of the hydraulic fluid circuit extends along each of the hydraulic cylinder units between the drilling fluid outlet and the safety valve arrangement.

10. The system according to claim 9, wherein the second hydraulic fluid line is in communication with the first hydraulic fluid line via the hydraulic line manifold.

11. The system according to claim 7, wherein a control unit is provided to monitor the hydraulic fluid pressure in each of the hydraulic cylinder units and to monitor the gas reservoir.

12. The system according to claim 1, wherein the hydraulic fluid circuit is provided with a stop valve arranged to be able to close a hydraulic fluid inlet in the accumulator unit at a sudden pressure drop in the hydraulic fluid circuit.

13. The system according to claim 1, wherein each of the hydraulic cylinder units is provided with a piston lock arranged to be able to hold a piston rod mechanically fixed in a releasable grip when the piston rod is in a retracted position.

14. The system according to claim 1, wherein the pipe string is a workover riser.

15. The system according to claim 1, wherein the safety valve arrangement is configured to prevent fluid communication between each of the hydraulic cylinder units and the accumulator unit as long as hydraulic fluid pressure in each of the hydraulic cylinder units is maintained within an upper hydraulic fluid limit and a lower hydraulic fluid limit.

16. A release module device for attaching a pipe string in a top drive connected to a heave compensator and arranged on a floating installation, the device comprising at least two suspension stays interconnected via a pipe clamp, wherein each suspension stay is constituted of a hydraulic cylinder unit forming an extendable connection between the top drive and a portion of the pipe string, and each of the hydraulic cylinder units is connected in a fluid communicating manner to an accumulator unit via a hydraulic fluid circuit, wherein the hydraulic fluid circuit comprises a safety valve arrangement, wherein a drilling fluid line arranged for fluid communication with a drilling fluid outlet arranged on the top drive encloses at least a portion of a first hydraulic fluid line of the hydraulic fluid circuit forming a communication between each of the hydraulic cylinder units and the accumulator unit which is connected to a pressurized gas reservoir, and wherein the first hydraulic fluid line of the hydraulic fluid circuit is inserted through a branch into the drilling fluid line and connected to a hydraulic line manifold arranged at the drilling fluid outlet on the top drive.

17. A release module device for attaching a pipe string in a top drive connected to a heave compensator and arranged on a floating installation, the device comprising at least two suspension stays interconnected via a pipe clamp, wherein each suspension stay is constituted of a hydraulic cylinder unit forming an extendable connection between the top drive and a portion of the pipe string, and each of the hydraulic cylinder units is connected in a fluid communicating manner to an accumulator unit via a hydraulic fluid circuit, wherein the hydraulic fluid circuit comprises a safety valve arrangement configured to be responsive to hydraulic fluid pressure within each of the hydraulic cylinder units to permit or prevent fluid communication between each of the hydraulic cylinder units and the accumulator unit, wherein a drilling fluid line arranged for fluid communication with a drilling fluid outlet arranged on the top drive, encloses at least a portion of a first hydraulic fluid line of the hydraulic fluid circuit forming a communication between each of the hydraulic cylinder units and the accumulator unit which is connected to a pressurized gas reservoir, wherein the first hydraulic fluid line of the hydraulic fluid circuit is inserted through a branch into the drilling fluid line and connected to a hydraulic line manifold arranged at the drilling fluid outlet on the top drive, and wherein a second hydraulic fluid line of the hydraulic fluid circuit extends along each of the hydraulic cylinder units between the drilling fluid outlet and the safety valve arrangement.

* * * * *